US008938186B2

(12) United States Patent
Pitas et al.

(10) Patent No.: US 8,938,186 B2
(45) Date of Patent: Jan. 20, 2015

(54) METHOD OF ALIGNING A PHOTOCONDUCTOR CARTRIDGE

(75) Inventors: Jeffrey A. Pitas, Macedon, NY (US); Richard G. Luther, Hamlin, NY (US); Matthias H. Regelsberger, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 611 days.

(21) Appl. No.: 12/872,202

(22) Filed: Aug. 31, 2010

(65) Prior Publication Data

US 2012/0051780 A1 Mar. 1, 2012

(51) Int. Cl.
*G03G 21/16* (2006.01)
*G03G 15/00* (2006.01)
*G03G 21/18* (2006.01)

(52) U.S. Cl.
CPC ..... *G03G 21/1842* (2013.01); *G03G 21/186* (2013.01)
USPC ..... 399/111; 399/117; 399/167

(58) Field of Classification Search
USPC ..... 399/110, 111, 116, 117, 167
See application file for complete search history.

(56) References Cited

U.S. PATENT DOCUMENTS

| | | | | |
|---|---|---|---|---|
| 5,930,002 | A * | 7/1999 | Haneda et al. | 358/300 |
| 6,366,748 | B1 * | 4/2002 | Takeuchi et al. | 399/111 |
| 7,711,287 | B2 * | 5/2010 | Kimizuka et al. | 399/111 |
| 2007/0071482 | A1 * | 3/2007 | Okabe | 399/90 |

* cited by examiner

*Primary Examiner* — Joseph S Wong
(74) *Attorney, Agent, or Firm* — Nelson Adrian Blish

(57) ABSTRACT

A method for aligning a photoconductor cartridge (200) in an electrophotographic device includes providing at least two holes in a first end of the cartridge. At least two pins (251) are provided in a frame of the electrophotographic device which mate with the holes in the first end of the cartridge when the cartridge is inserted in the electrophotographic device. A drive mechanism contacts a spherical bearing of a photoconductor of the cartridge and drives a pair of drive dogs. One drive dog is affixed to a spline on the drive mechanism and a second drive dog is affixed to the spherical bearing. At least one hole is provided in a second end of the cartridge. At least one pin is provided in a frame of the electrophotographic device which mate with the hole in the second end of the cartridge when the cartridge is inserted in the electrophotographic device.

1 Claim, 6 Drawing Sheets

METHOD OF ALIGNING A PHOTOCONDUCTOR CARTRIDGE

FIELD OF THE INVENTION

This invention relates in general to an electrophotographic device, and in particular to a method of aligning a photoconductor cartridge in the electrophotographic device.

BACKGROUND OF THE INVENTION

The electrophotographic process creates an image on paper or other suitable printing media. Various components are assembled into a print engine to enable printing. In order for those components to function correctly they must be mounted within the printer precisely and rigidly. The more precisely components are aligned minimizes correction needed for accurate image placement on paper.

In an electrophotographic device the photoconductor periodically needs to be replaced due to wear, damage, or degradation. The most efficient way to replace a photoconductor is to incorporate it in a cartridge along with some other key components of the electrophotographic device.

There is a need, therefore, to accurately locate a photoreceptive cartridge in a manner which minimizes image registration correction.

SUMMARY OF THE INVENTION

Briefly, according to one aspect of the present invention a method for aligning a photoconductor cartridge in an electrophotographic device includes providing at least two holes or at least two pins or a combination thereof in a first end of the cartridge. At least two holes or at least two pins or a combination thereof are provided in a frame of the electrophotographic device which mate with the at least two holes or at least two pins or a combination thereof in the first end of the cartridge when the cartridge is inserted in the electrophotographic device.

The cartridge is inserted into the electrophotographic device and a drive mechanism contacts a spherical bearing of a photoconductor of the cartridge. The photoconductor drives a pair of drive dogs wherein one drive dog is affixed to a spline on the drive mechanism and a second drive dog is affixed to the spherical bearing.

At least one hole or at least one pin is provided in a second end of the cartridge. At least one hole or at least one pin is provided in a frame of the electrophotographic device which mates with the at least one hole or at least one pin in the second end of the cartridge when the cartridge is inserted in the electrophotographic device.

The invention and its objects and advantages will become more apparent in the detailed description of the preferred embodiment presented below.

DETAILED DESCRIPTION OF THE INVENTION

The present invention will be directed in particular to elements forming part of, or in cooperation more directly with the apparatus in accordance with the present invention. It is to be understood that elements not specifically shown or described may take various forms well known to those skilled in the art.

Figure 1:
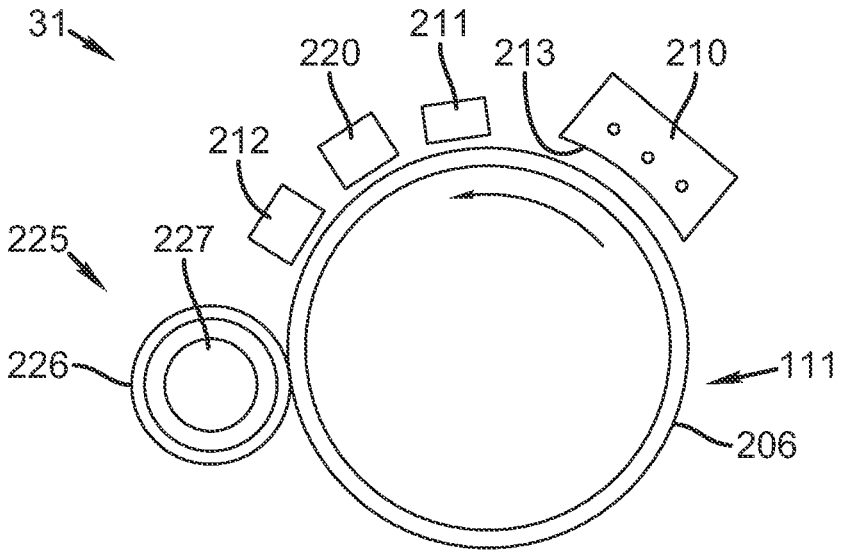
FIG. 1 is a cross-section of a replacement cartridge according to the present invention.

Referring now to FIG. 1 an electrophotographic printer includes all components necessary to accomplish the task of printing an image on paper. Various sub-assemblies perform specific functions.

An imaging module in the printer consists of components to enable printing of a single color image. Multiple modules may be assembled to enable the printing of multiple color images. FIG. 1 shows details of a typical printing module 31, which may be assembled with other imaging modules to enable printing multiple colors.

Primary charging subsystem 210 uniformly electrostatically charges photoreceptor 206 of photoreceptive member 111, shown in the form of an imaging cylinder. Charging subsystem 210 may include a grid 213 having a selected voltage, or may be in the form of a roller with conductive properties.

Additional necessary components provided for control may be assembled around the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206.

Image writer 220 is used to expose photoreceptor 206 and may be a light emitting diode (LED) array or other similar mechanisms. Toning unit 225, comprising elements 226 and 227 is used to develop the latent image created by image writer 220 on photoreceptor 206. Cleaning unit 230 removes residual toner from photoreceptor 206 after transfer of the image to a secondary receiver. Other meters and components may be included.

Within the printing module 31, periodic replacement of critical components is necessary to ensure proper function. It may be desirable to cluster multiple components to enable simultaneous replacement.

Figure 2:
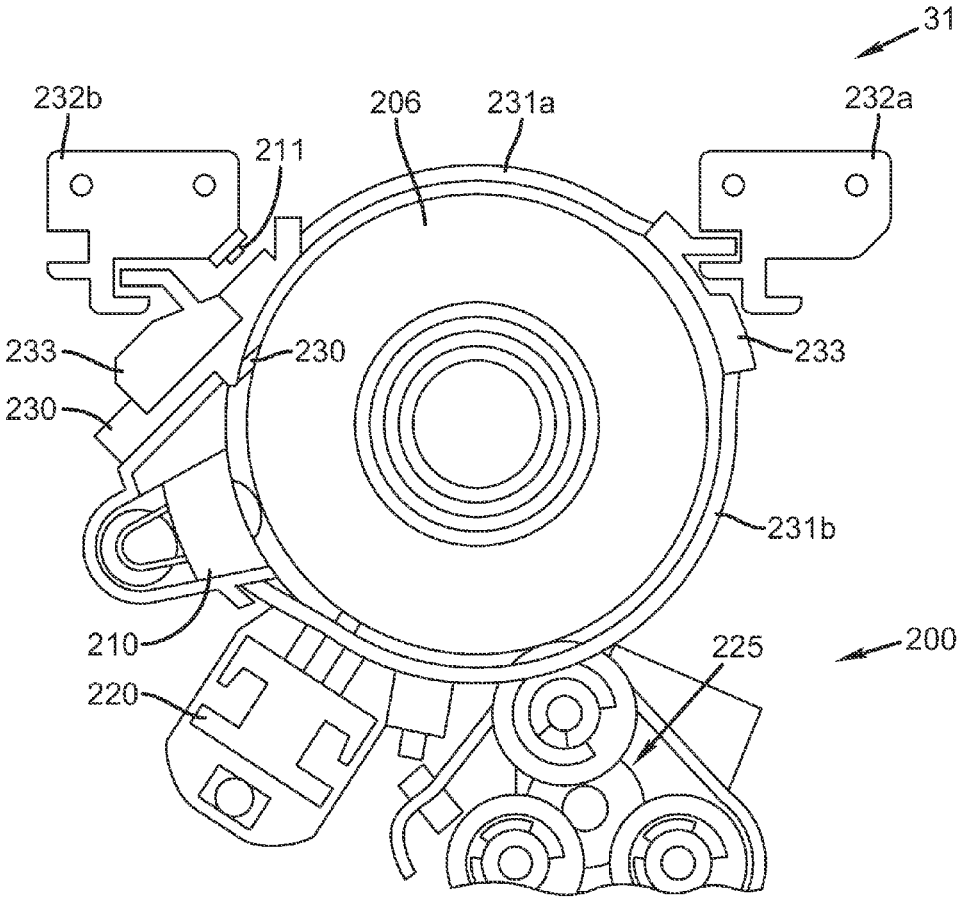
FIG. 2 is a cross-section of a replacement cartridge in an electrophotographic printer.

Referring to FIG. 2, shown here with a change in form for the present invention, a replacement cartridge 200 is created consisting of a photoreceptive member 111, cleaning system 230, and charger 210. These components are assembled into a cartridge and held in place with a plastic housing 233. The replacement cartridge slides into the electrophotographic printer with guides 232*a* and 232*b*. Guides 232*a* and 232*b* are attached to the printer and help mount and align the replacement cartridge in the proper position. Guards 231*a* and 231*b* protect the photoreceptor 206 from damage.

Figure 3:
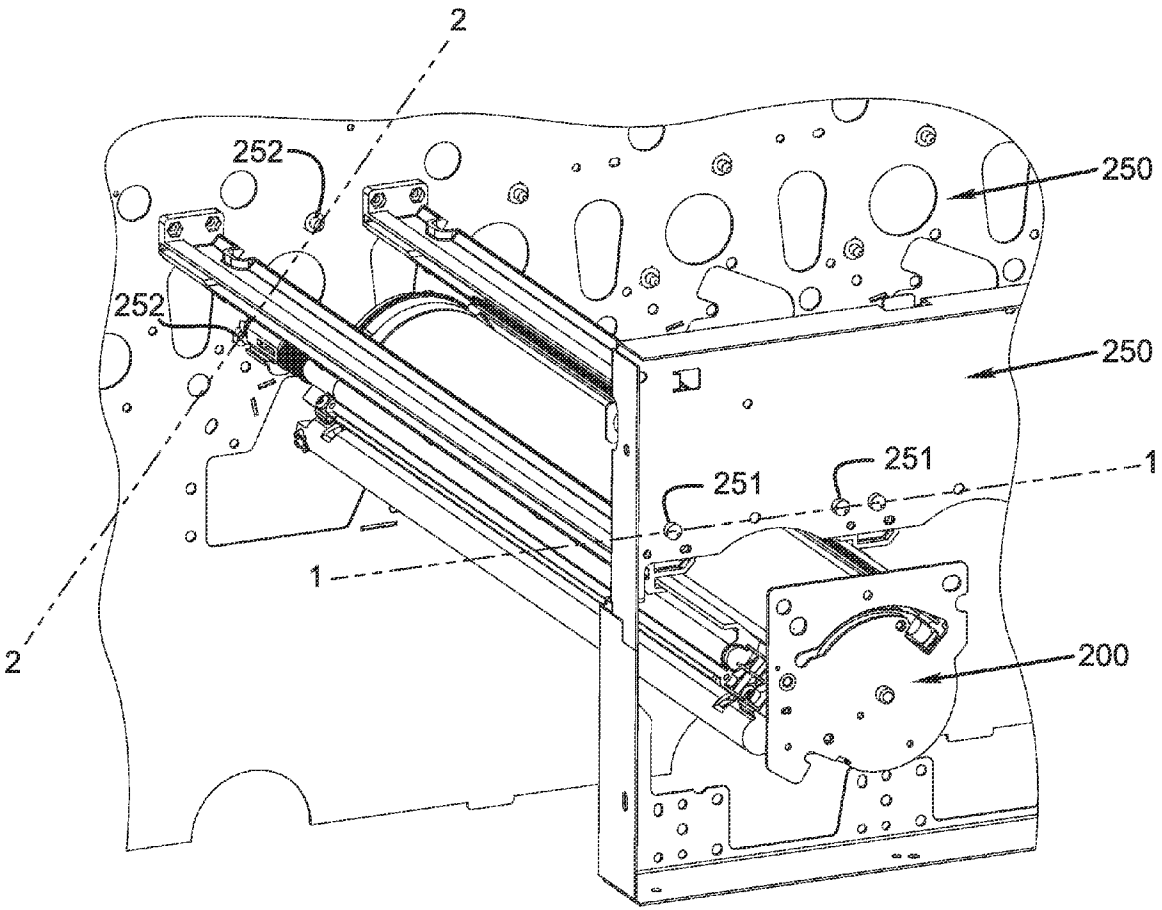
FIG. 3 is a perspective view of a replacement cartridge being assembled to a framework.

Referring now to FIG. 3 is shown the cartridge oriented to a framework 250. The framework 250 is designed to accommodate many subsystems which all depend on the precision of framework features for proper alignment. Attached to the framework are alignment pins 251 and 252. As the replacement cartridge 200 is slid into the frame on guides 232*a* and 232*b*, and as it approaches the framework 250 front and rear plates, the guides 232*a* and 232*b* funnel the cartridge onto the alignment pins 251 and 252 which are tapered to further register the replacement cartridge 200 with respect to the framework 250.

Figure 4:
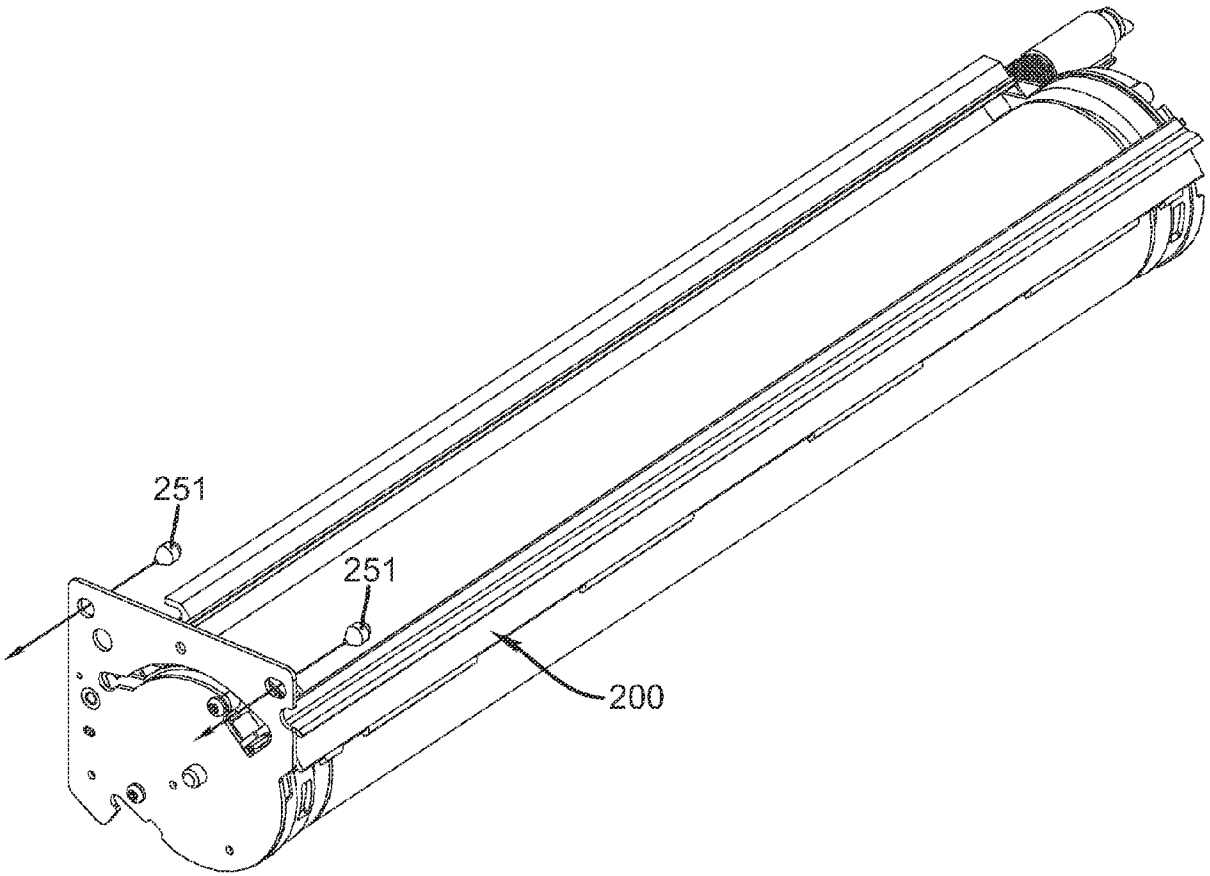
FIG. 4 is a perspective view of the front of a replacement cartridge and alignment pins as it is being assembled to a framework.

Referring now to FIG. 4 is shown two tapered alignment pins 251 which are mounted in a framework 250, hidden for clarity, at the front of the replacement cartridge 200 which align to a hole and slot in the front of the cartridge during insertion. Alternately the alignment pins 251 may be arranged in the cartridge and hole and slot in the framework or a combination.

Figure 5:
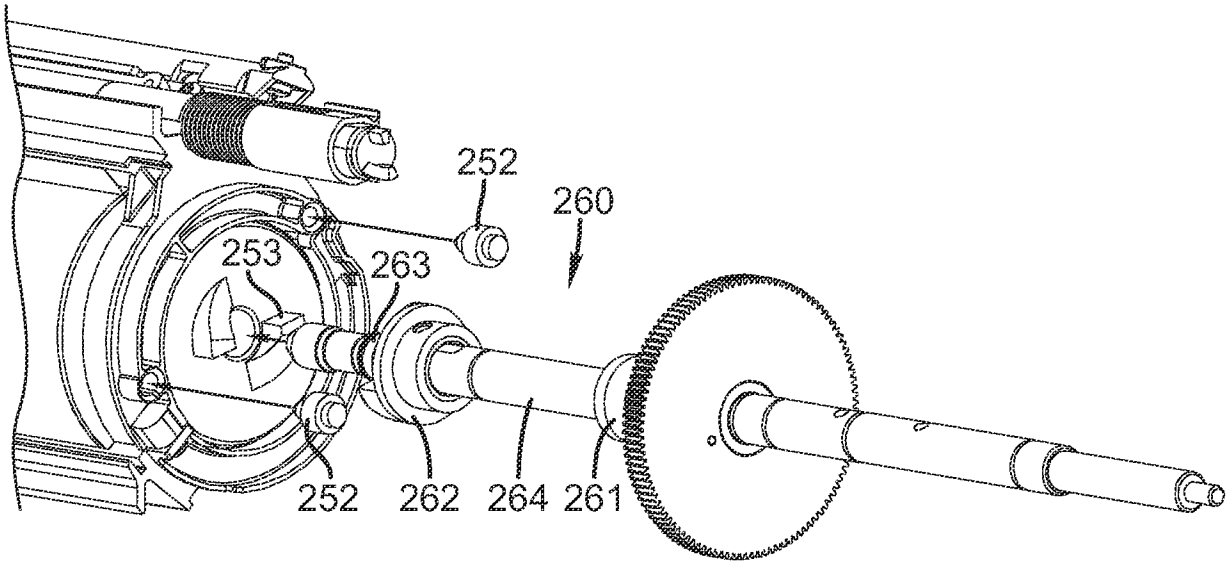
FIG. 5 is a perspective view of the rear of a replacement cartridge and alignment pins and drive as it is being assembled to a framework.

Referring now to FIG. 5 is shown two tapered alignment pins 252 mounted in a framework 250, hidden for clarity, at the rear of the replacement cartridge 200 which align to a hole and slot in the rear of the cartridge during insertion. Alternately the alignment pins 252 may be arranged in the cartridge and hole and slot in the frame or a combination.

The accurate location of the photoreceptive member 111 is critical for registering accurately an image on paper in a printing application. By accurately locating the photoreceptor with respect to the framework, registration correction by other means is eliminated or unnecessary. The hole and slot and pin arrangement serve to exactly locate with respect to the framework 250 the replacement cartridge 200 at both the front and rear of the cartridge. This arrangement is used for a design which is torsionally non-rigid. For designs that are torsionally rigid on either the front or rear of the cartridge one pin is omitted and one slot, so that a total of three pins determine exact location of the replacement cartridge. Further, if the pin constraint pattern is chosen such that the pins are non-coplanar, additional flexural rigidity is obtained in mounting of the cartridge. FIG. 3 shows that line 1-1 connecting tapered alignment pins 251 is not parallel to line 2-2 connecting tapered alignment pins 252, and therefore the pins are not coplanar.

Figure 6:
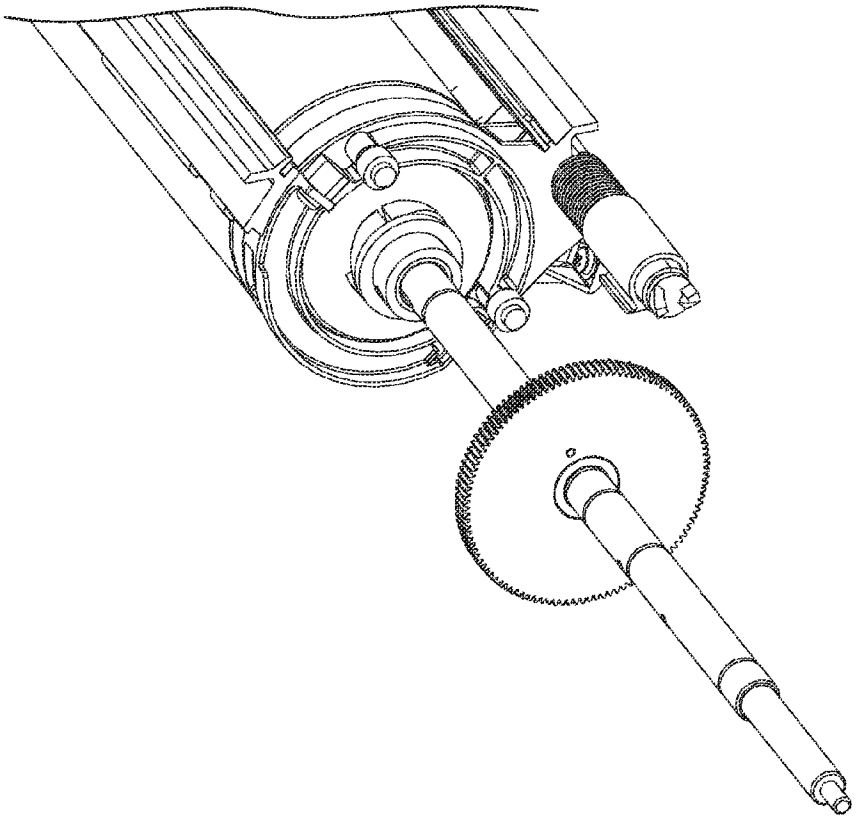
FIG. 6 is a perspective view of the rear of a replacement cartridge, alignment pins, and drive assembled to a framework.

Also shown in FIG. 5 and in FIG. 6 is a means for drive coupling at the rear of photoreceptive member 111. Photoreceptive member 111 has mounted a drive coupling 253 which engages to a spring loaded drive coupling 262 mounted to drive system 260, which ensures constant engagement of drive when the replacement cartridge 200 is assembled to the framework 250. To ensure drive fluidity the drive coupling provides only rotational constraint.

For precise drive control, the shaft 264 which mounts the drive coupling 263 must be accurately centered with tight clearance to the photoreceptive member 111. The use of a drive shaft 264 creates an additional constraint to the replacement cartridge 200 which may cause binding and premature wear.

Two forms of misalignment must be addressed to eliminate this constraint, angular misalignment and positional misalignment of location of the drive. Angular misalignment is addressed through the use of a spherical bushing within the photoreceptor, or a spherical feature 263 on the drive shaft 264. Positional misalignment of the center of the drive shaft and photoreceptor is addressed by designing clearance in the drive support bushing 261 which allow the drive shaft 264 to center on the photoreceptive member 111.

The invention has been described in detail with particular reference to certain preferred embodiments thereof, but it will be understood that variations and modifications can be effected within the scope of the invention.

PARTS LIST

31 printing module
111 photoreceptive member
200 replacement cartridge
206 photoreceptor
210 charging subsystem
211 meter
212 meter
213 grid
220 image writer
225 toning unit
226 element
227 element
230 cleaning unit
231*a* guard
231*b* guard
232*a* guide
232*b* guide
233 plastic housing
250 framework
251 alignment pin
252 alignment pin
253 drive coupling
260 drive system
261 bushing
262 drive coupling
263 spherical feature
264 drive shaft
1-1 line between pins 251
2-2 line between pins 252

The invention claimed is:

1. A method for aligning a photoconductor cartridge in an electrophotographic device comprising:

providing at least two holes or at least two pins or a combination thereof in a first end of the cartridge;

providing at least two holes or at least two pins or a combination thereof in a frame of the electrophotographic device which mate with the at least two holes or at least two pins or a combination thereof in the first end of the cartridge when the cartridge is inserted in the electrophotographic device;

inserting the cartridge into the electrophotographic device;

contacting a drive mechanism with a spherical bearing of the photoconductor cartridge;

driving the photoconductor with a pair of drive dogs wherein one drive dog is affixed to a spline on the drive mechanism and a second drive dog is affixed to the spherical bearing;

providing at least two holes or at least two pins in a second end of the cartridge;

providing at least two holes or at least two pins in the frame of the electrophotographic device which mate with the at least two holes or at least two pins in the second end of the cartridge when the cartridge is inserted in the electrophotographic device;

wherein the pins are tapered and seat and position the cartridge as the cartridge is slid into registration with the framework of the electrophotographic device; and wherein a first line connecting the at least two holes or at least two pins or a combination thereof in a first end of the cartridge and a second line connecting the at least two holes or at least two pins in a second end of the cartridge are not parallel.

* * * * *